US005886594A

United States Patent [19]

Guglielmi et al.

[11] Patent Number: 5,886,594

[45] Date of Patent: Mar. 23, 1999

[54] CIRCULAR WAVEGUIDE DUAL-MODE FILTER

[75] Inventors: Marco Guglielmi, Wassenaar, Netherlands; Benito Gimeno, Valencia, Spain

[73] Assignee: Agence Spatiale Europeenne, Paris, France

[21] Appl. No.: 858,943

[22] Filed: May 20, 1997

[30] Foreign Application Priority Data

May 22, 1996 [FR] France ..... 96 06337

[51] Int. Cl.[6] ..... H01P 1/208

[52] U.S. Cl. ..... 333/208; 333/212

[58] Field of Search ..... 333/21 A, 208, 333/212, 227, 230

[56] References Cited

U.S. PATENT DOCUMENTS

| | | | |
|---|---|---|---|
| 3,697,898 | 10/1972 | Blachier et al. | 333/21 A |
| 4,028,651 | 6/1977 | Leetmaa | 333/212 |
| 4,030,051 | 6/1977 | Shimizu et al. | 333/227 |
| 4,241,323 | 12/1980 | Griffin et al. | 333/212 X |
| 5,349,316 | 9/1994 | Sterns | 333/208 |

FOREIGN PATENT DOCUMENTS

| | | | |
|---|---|---|---|
| 60-174501 | 9/1985 | Japan | 333/212 |
| 61-65501 | 4/1986 | Japan | 333/212 |

OTHER PUBLICATIONS

Chang, Hsin–Chin et al., "Evanescent–Mode Coupling of Dual–Mode Rectangular Waveguide Filters ", *IEEE Transactions on Microwave Theory and Techniques*, Vol. 39, No. 8, Aug. 1991, pp. 1307–1312.

*Primary Examiner*—Seungsook Ham
*Attorney, Agent, or Firm*—Alston & Bird LLP

[57] ABSTRACT

The invention relates to a circular waveguide dual-mode filter comprising at least one element for adjusting a filter parameter. Said element is an elliptical waveguide portion disposed perpendicularly to the longitudinal axis of said circular waveguide. The filter may be coupled to an inlet circular waveguide and to an outlet circular waveguide.

11 Claims, 6 Drawing Sheets

CIRCULAR WAVEGUIDE DUAL-MODE FILTER

The present invention relates to a circular waveguide dual-mode filter of the type including at least one element for adjusting a parameter of the filter.

BACKGROUND OF THE INVENTION

Circular waveguide dual-mode filters are very widely used in multiplexers on-board telecommunications satellites. Manufacture thereof requires a complicated step consisting in manually tuning the filter, thus giving rise to high cost and lengthy development time.

In the basic configuration, two resonances are excited in the same cylindrical waveguide cavity, thereby enabling the dimensions of the device to be reduced. Another advantage of that known configuration is that it is possible to use coupling between non-adjacent cavities and also to achieve transmission zeros. By way of example, this is described in an article by A. E. Williams entitled "A four-cavity elliptic waveguide filter", published in IEEE Transactions MTT-18, December 1970, pages 1100 to 1104, and in an article by A. E. Atia et al., entitled "Narrow-bandpass waveguide filters", published in IEEE Transactions MTT-20, April 1972, pages 258 to 265.

Cross coupling can be obtained within each cavity by means of an adjustment screw, and cross coupling can also be obtained between adjacent cavities by means of a cross-shaped iris. In addition, to enable each resonance to be synchronous, i.e. for all of the cavities to have the same resonant frequency, other adjustment screws are added for independent adjustment, and in particular for frequency tuning. As a result, a filter generally has at least three adjustment screws per cavity, and each of the screws needs to be adjusted manually.

To reduce or eliminate this adjustment step, it is necessary to have available a complete wave representation of the adjustment screws. Although that is theoretically possible, e.g. by implementing the method of finite elements, the computation time required by such a concept is unacceptable in practice.

Proposals have recently been made in an article by M. Guglielmi et al., entitled "Dual-mode filters without tuning screws", published in IEEE Microwave and Guided Wave Letters, Vol. 2, No. 11, November 1992, pages 457 and 458, for solving the problem by using a waveguide having circular ribs. The article by Xiao-Peng Liang entitled "Dual-mode coupling by square corner cut in resonator and filters", published in IEEE Transactions on Microwave Theory and Techniques, Vol. 40, No. 12, December 1992, pages 2294 to 2302, proposes a waveguide having a square-shaped cutout. Both of those two solutions are of interest, but they suffer from the drawback of requiring non-standard waveguide mode analysis which makes use of computation that is very complicated and requires very long computation time.

More recently, other shapes have been proposed for the purpose of eliminating the need for adjustment elements, in an article by R. Orta et al., entitled "A new configuration of dual-mode rectangular waveguide filters", published at pages 538 to 542 of the Proceedings of the 1995 European Microwave Conference held at Bologne, Italy, and in an article by S. Moretti et al., entitled "Field theory design of a novel circular waveguide dual-mode filter", published at pages 779 to 783 of the Proceedings of the 1995 European Microwave Conference at Bologne in Italy. Nevertheless, it is necessary in practice to have control over the resonant frequency so as to compensate for manufacturing tolerances and so as to enable very accurate frequency adjustment to be performed, as is required in narrow band applications.

OBJECTS AND SUMMARY OF THE INVENTION

The idea on which the invention is based is to implement one or more elliptical waveguide sections for performing the desired functions. Modal analysis of such a waveguide can be performed quickly and, in addition, it is easy to fabricate an elliptical profile with excellent accuracy, in particular by electro-erosion, thereby avoiding the need to perform subsequent adjustments.

The device of the invention thus makes it possible to omit adjustment screws while being capable of practical implementations that can be modelled on a computer.

The invention thus provides a circular waveguide dual-mode filter comprising at least one element for adjusting a parameter of the filter, wherein said element is an elliptical portion of waveguide disposed perpendicularly to a longitudinal axis of said circular waveguide.

In general, the circular waveguide is coupled to an inlet waveguide having an incident field in first and second mutually perpendicular directions that are perpendicular to the longitudinal axis of the circular waveguide.

In a first variant enabling independent frequency adjustment to be obtained in a dual-mode cavity, the elliptical waveguide portion has an axis in alignment with the first direction.

In a second variant, enabling cross coupling to be obtained in a dual-mode cavity, a portion of elliptical waveguide has a major axis forming an angle of substantially 45° relative to the first and second directions.

For a dual-mode filter in which it is possible to have only one dual-mode cavity, the circular waveguide may include a cavity coupled to said inlet waveguide and to an outlet waveguide having long axes that are at an angle of substantially 90° to each other.

In a filter having at least four poles, the circular waveguide may include at least a first cavity and a second cavity that are coupled together via a coupling iris and each of which includes one of said elliptical waveguide portions. Preferably, said coupling iris is an elliptical coupling iris having a major axis perpendicular to said first direction. Advantageously, the major axes of the elliptical waveguide portions are mutually parallel and form an angle of substantially 45° with said first direction.

In a preferred embodiment, each cavity includes an adjustment elliptical waveguide portion interposed between said elliptical waveguide portion and said coupling iris.

The first cavity may be coupled to said inlet waveguide and the filter may also include an outlet waveguide coupled to the second cavity, the inlet and outlet waveguides, which may be rectangular waveguides or elliptical waveguides, for example, having long axes that are parallel.

The inlet waveguide and/or the outlet waveguide may be coupled to the circular waveguide by a portion of elliptical waveguide having a major axis that is parallel to the longitudinal axis of the corresponding inlet or outlet waveguide.

BRIEF DESCRIPTION OF THE DRAWINGS

Other characteristics and advantages of the invention appear more clearly on reading the following description, given by way of non-limiting example and with reference to the drawings, in which:

FIG. 5*a* shows a filter having two transmission zeros and four poles, with FIG. 5*b* being a section view, and FIG. 6 showing an example of a response curve for modes S11 and S12, while

MORE DETAILED DESCRIPTION

Figure 1A:
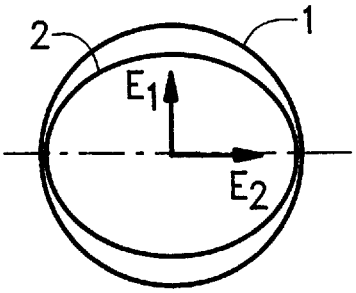
FIGS. 1*a* to 1*c* show three examples of plane junction interfaces between an elliptical waveguide and a circular waveguide.

FIG. 1*a* shows a plane junction between a circular waveguide 1 and an elliptical waveguide 2, in which the major axis of the elliptical waveguide 2 is in alignment with a direction of the incident electric field from the circular waveguide 1. In the drawing, the major axis of the waveguide 2 is in alignment with the field E2 of the circular waveguide 1. There is no coupling between the orthogonal modes of the circular waveguide. However, because of the different sizes of the two axes of the waveguide 2, the two polarizations E1 and E2 emerge at the outlet from the waveguide section 2 with phass that are different. As a result, this configuration can be used for independent frequency adjustment in a dual-mode cavity.

Figure 1B:
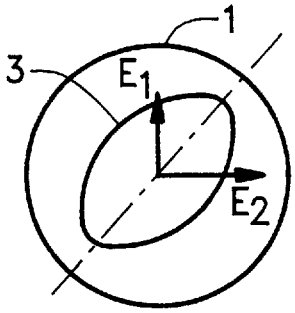

Assuming now that the elliptical waveguide is a waveguide 3 whose major axis is at an angle of 45° with the directions E1 and E2, as shown in FIG. 1*b*, then energy is interchanged between the two incident polarizations E1 and E2 as they propagate along the waveguide portion 3, but, at the outlet, they emerge with the same phase. As a result, this configuration can be used to perform cross coupling in a dual-mode cavity.

In addition, cross coupling between adjacent cavities, which is traditionally achieved by means of a cross-shaped iris, can also be achieved by means of an elliptical iris 4 in which the dimensions of the two axes (major and minor) are selected to obtain the desired intensity of coupling between the two orthogonal polarizations. This is shown in FIG. 1*c*.

Implementing elliptical waveguide portions (or elliptical section irises) has the advantage of enabling a microwave filter to be made by using accurate techniques such as rectification or electro-erosion, which techniques enable high accuracy to be obtained for this type of shape.

Figure 1C:
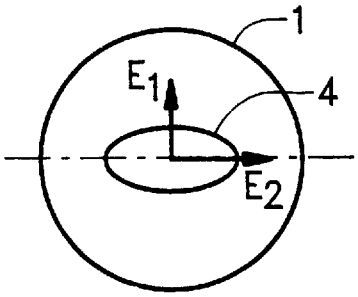
Figure 2:
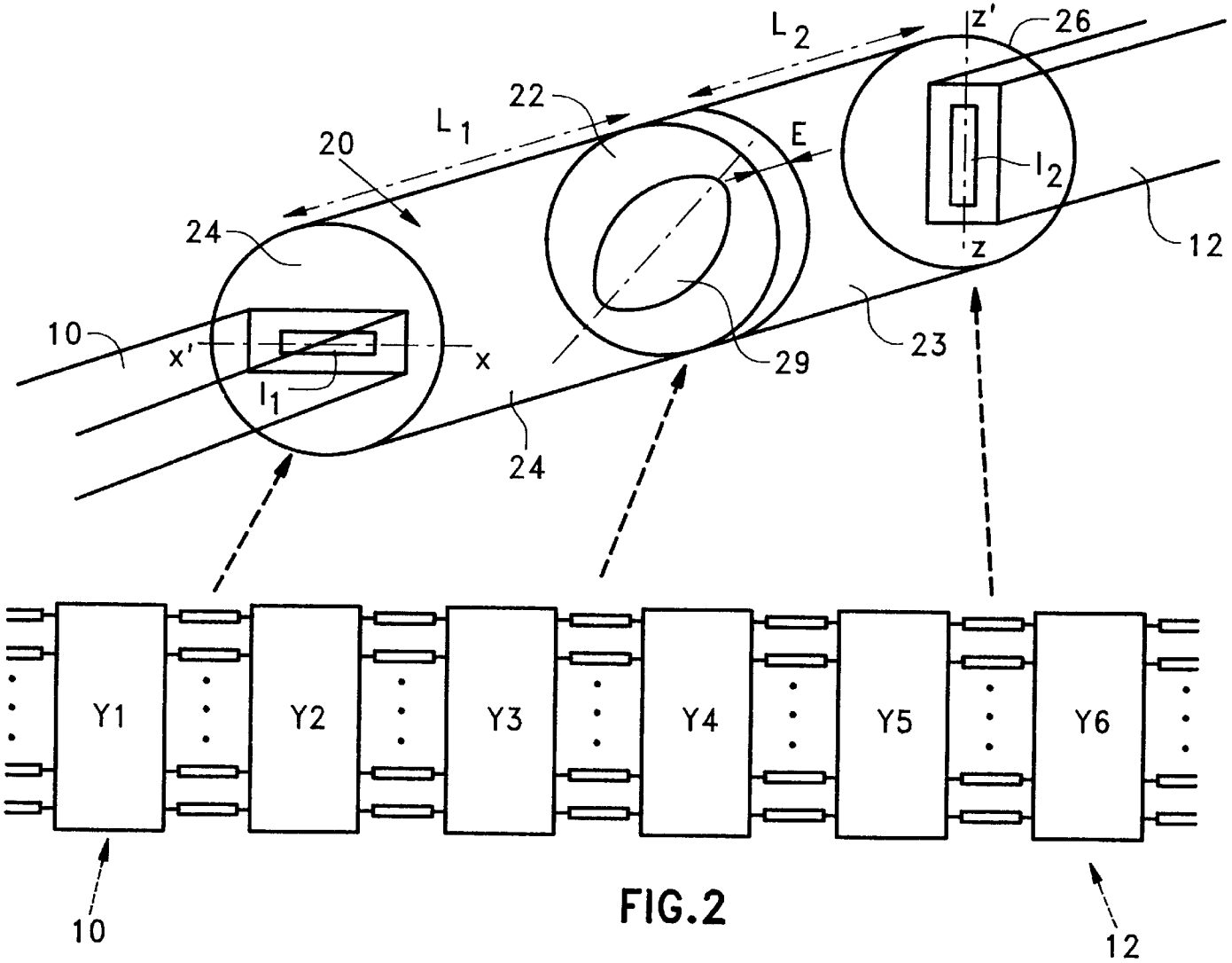
FIG. 2 shows a dual-mode cavity filter of the invention and FIG. 3 shows the response curve thereof for the S11 and S12 modes.

The plane junctions of FIGS. 1*a* to 1*c* can be studied electromagnetically in acceptable manner by using the multimode admittance matrix formulation as given, for example, in the article by A. Alvarez et al., entitled "New simple procedure for the computation of the multimode admittance matrix of arbitrary waveguide junction", published in 1995 in IEEE MTT-S Digest, pages 1415 to 1418. That formulation makes it possible to obtain results that are reliable and very accurate. Cascades of Junctions can be studied in the same way by writing a complete representation in an array, as shown at the bottom of FIG. 2 for a single multimode cavity. This array representation makes it easy to obtain a linear system which, by conventional inversion, makes it possible to deduce very accurately the electrical behavior of the entire structure. The teaching of the above-document by A. Alvarez et al. makes it possible to solve the problem by calculating coupling integrals between the modes of elliptical and circular waveguides.

The modes of elliptical waveguides are obtained in conventional manner in the form of Mathieu functions. Reference can be made in particular to the work by N. Marcuvitz, entitled "Microwave handbook", published by Peter Peregrinus Ltd., London (1986).

In practice, using Mathieu functions directly gives rise to several complexities, which tend to increase computation time. Below we give a method of computation based on rewriting the Helmholtz equation in the form of linear eigen values, and subsequently implementing the method of moments.

Initially a set of base functions is selected that already satisfies the conditions at the limits in elliptical coordinates, thus enabling the process to be made very efficient and accurate.

This modal analysis relies on transforming the Helmholtz equation into elliptical coordinates in the form of an equation having eigen values in an equivalent matrix, using the Galerkin method. Use is made of a series of sine and cosine base functions that satisfy directly the conditions at the Dirichlet or Neumann limits for the electric components (TM modes) or for the axial magnetic components (TE modes). Such a technique is described in the article by A. Weisshaar et al., entitled "A rigorous and efficient method of moments solution for curved waveguide bends", published in IEEE Transactions on Microwave Theory and Technique, Vol. MTT-40, No. 12, pages 2200 to 2206, December 1992, or in the article by B. Gimeno, entitled "Multimode network representation for H- and E-plane uniform bends in rectangular waveguide", published in IEEE MTT-S International Symposium, pages 241 to 244, Orlando, Fla, USA, May 1995. In those articles, the technique is used to deduce the electromagnetic field in curved regions in such a manner as to enable uniform curves in a rectangular waveguide to be analyzed. The junction between rectangular, circular, or elliptical waveguides and an elliptical waveguide can be computed in the form of the multimode equivalent array representation described in the above-mentioned article by Alvarez et al., entitled "New simple procedure for the computation of the multimode admittance matrix of arbitrary waveguide junction".

Modal analysis of elliptical waveguides can thus be performed in a system of elliptical coordinates defined as the intersection of a family of confocal ellipses and a family of confocal hyperboles. In this respect, reference may be made to the work by N. W. McLachlan, entitled "Theory and application of Mathieu functions", published by Dover Publications Inc., 1st Edition, New York, USA, 1964. The following step is to derive the total magnetic field in the elliptical waveguides in terms of a vector mode function, taking account of Dirichlet or Neumann conditions or limits for TM or TE modes.

Thereafter, the Galerkin method is applied. This provides a linear matrix system of eigen values.

There exist two families of TM modes, written $TM_E$ and $TM_o$, corresponding respectively to even and odd solutions of the Mathieu functions (see the above-mentioned work by Marcuvitz). These modes are computed while taking account of conditions at the Dirichlet limits.

The same applies to TE modes. The solution of the Helmholtz equation for rectangular waveguides is well known in the technical literature. Reference may be made in particular to the above-mentioned work by Marcuvitz or indeed to the work by R. F. Harrington, entitled "Time-harmonic electromagnetic fields", published by McGraw Hill Publishing Company, USA, 1961. Those two works also make it possible to perform modal analysis of circular waveguides.

Once the modes of the elliptical, rectangular, and/or circular waveguides have been obtained, the following step is to analyze the discontinuities mentioned in FIGS. 1*a* to 1*c*. This can be done with the help of the teaching of the above-mentioned article by Alvarez et al.

For an incident rectangular $TE_{10}$ mode, only the following are excited in the discontinuity: rectangular $TE_{pq}.TM_{pq}$ modes where p is odd and q is even, and the elliptical $TE_e.TM_o$ modes.

For a junction between a circular waveguide and an elliptical waveguide, the overlap integrals must be computed in the reference system tied to the ellipse, and as a consequence, the polar coordinates tied to the circular waveguide must be transformed into elliptical coordinates associated with the elliptical waveguide.

Figure 3:
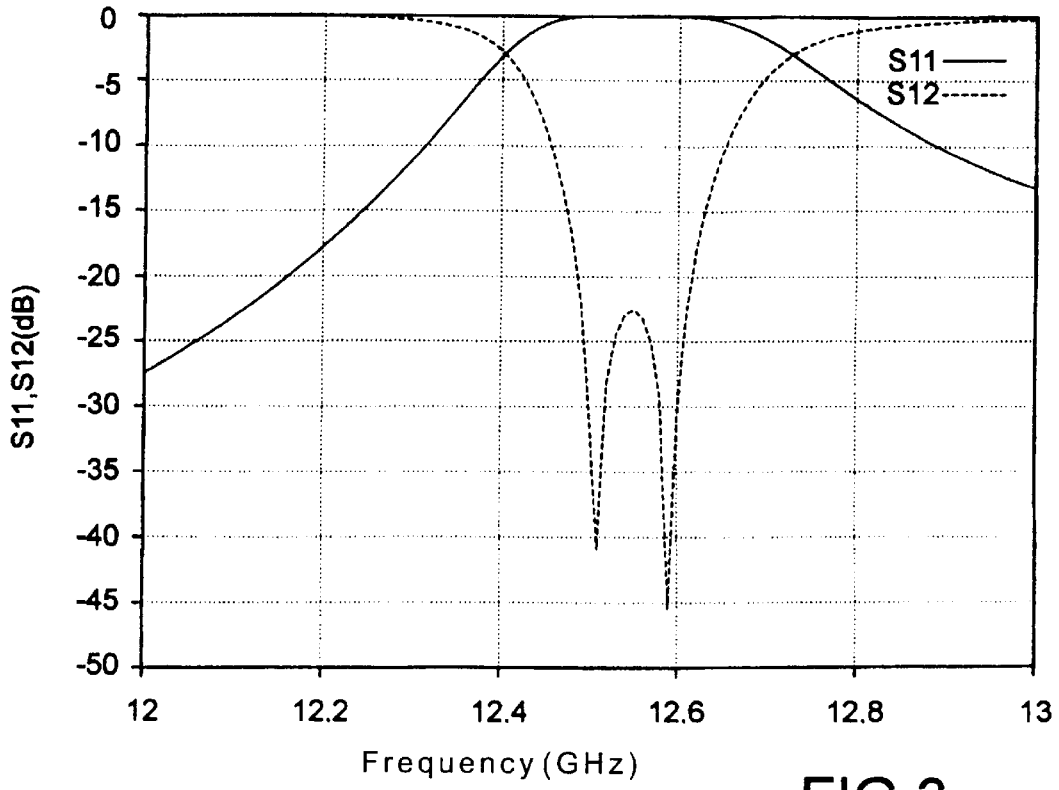

FIG. 2 shows a two-pole filter having a single thick elliptical iris 22 disposed within a circular waveguide 20 constituting a single cavity. The iris serves to obtain coupling between the two orthogonal resonances. The filter is coupled to an inlet waveguide 10, e.g. a rectangular waveguide, that forms a plane junction 24 with the waveguide 20, and it is also coupled to an outlet rectangular waveguide 12 that forms a plane junction 26 with the waveguide 20. The iris 22 is disposed perpendicularly to the longitudinal axis of the waveguide 20 and has an elliptical opening 29 whose major axis is inclined at 45° relative to the long axis x'x (horizontal on the drawing) of the waveguide 10 and to the long axis z'z (vertical on the drawing) of the waveguide 12. The two resonances are visible on the curves given in FIG. 3. The filter is designed Initially in the form of a two-part computation, namely a part independent of frequency for computing the coupling modes and integrals, followed by a part dependent on frequency for solving the linear system obtained from the complete representation in the form of arrays.

Figure 4:
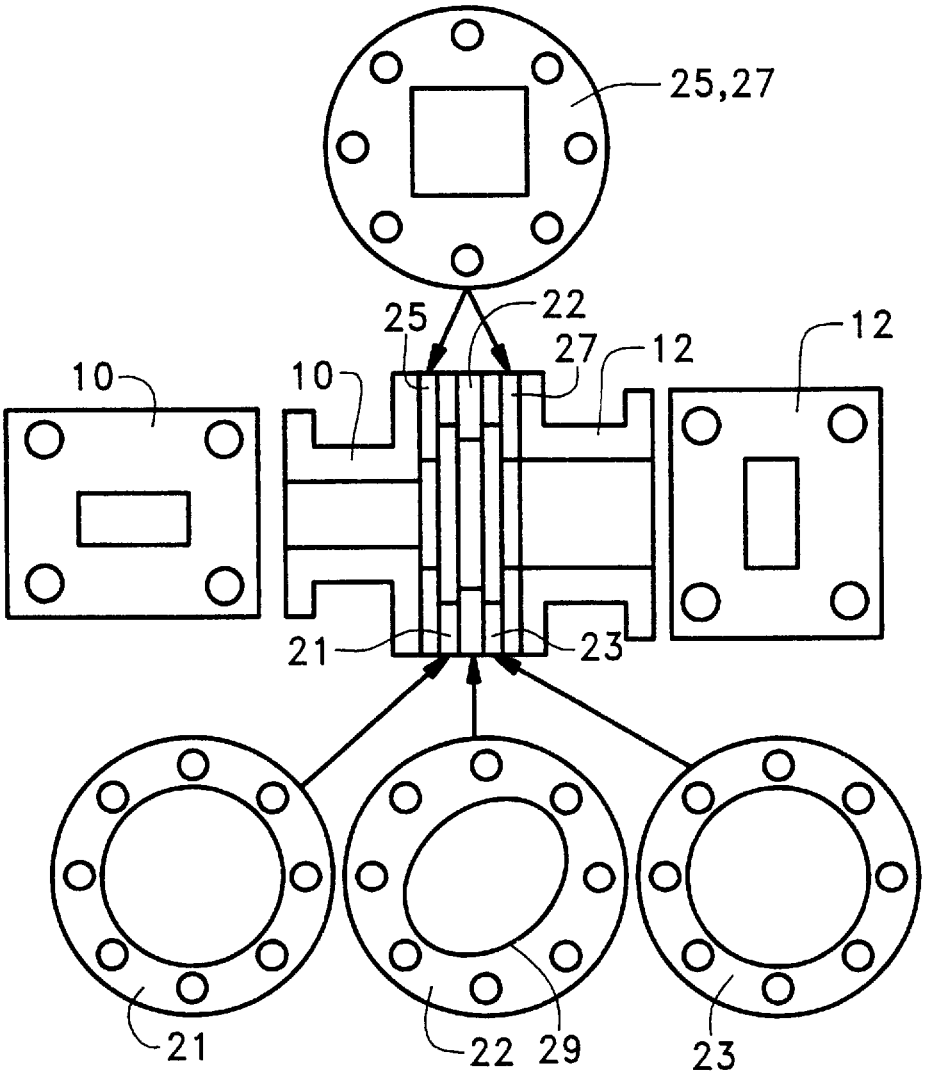
FIG. 4 shows a preferred embodiment of the FIG. 2 filter.

FIG. 4 shows a preferred embodiment of FIG. 2. The inlet and outlet waveguides 10 and 12 are coupled to the waveguide 20 by means of two respective square waveguide portions 25 and 27. The waveguide and the iris 22 are constituted by a stack comprising a circular waveguide section 21, an elliptical waveguide section 22, and a circular waveguide section 23. The waveguides 10 and 12 and the waveguide sections 21, 22, and 23 are shown in flat plan view in FIG. 4, as are the square waveguide sections 25 and 27.

Figures 5A, 5B:
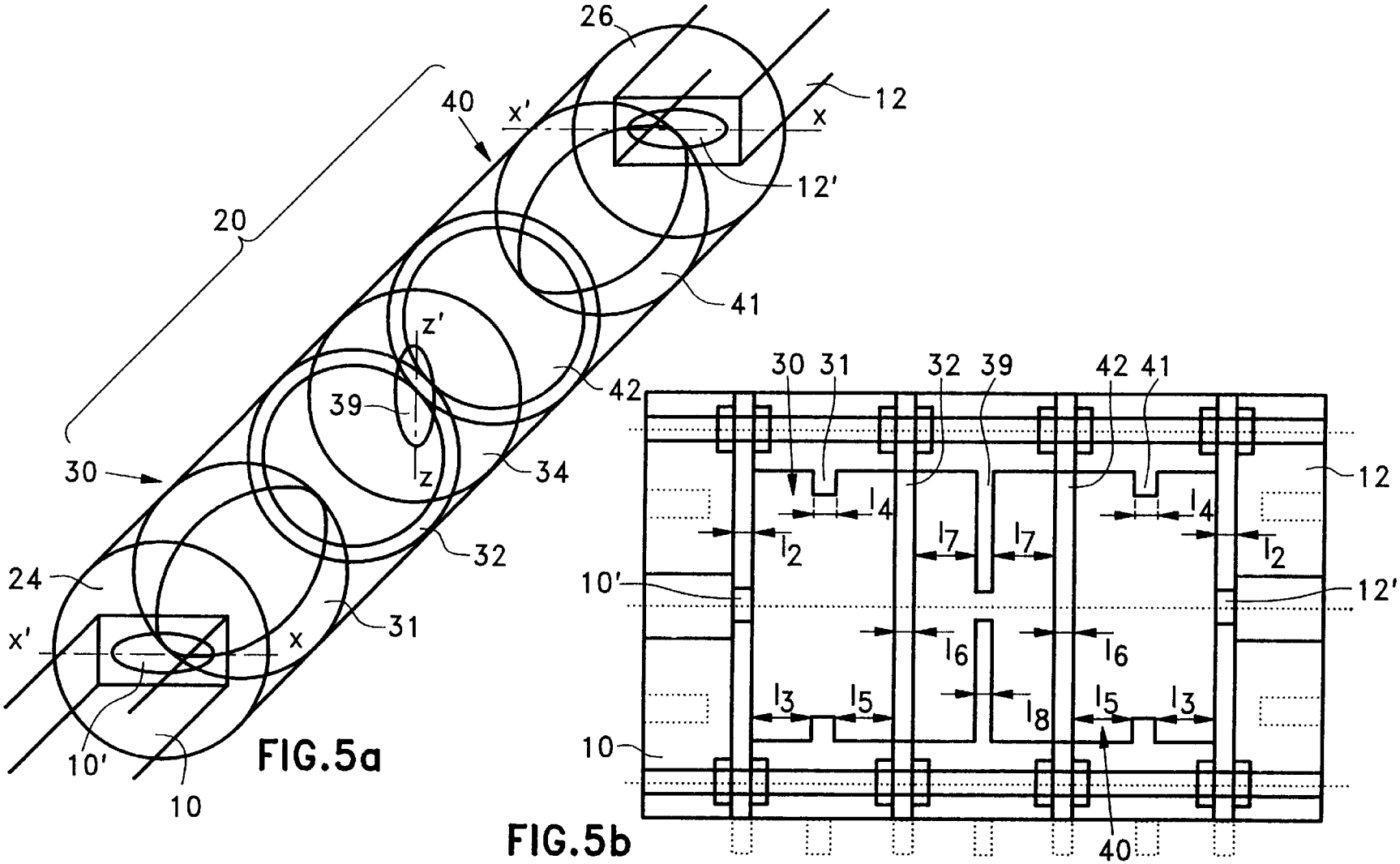

FIGS. 5*a* and 5*b* show a four-pole filter having two transmission zeros. The circular waveguide 20 has two cavities 30 and 40 that are coupled together via an elliptical iris 34 having an elliptical opening 39. The inlet and outlet waveguides 10 and 12 are shown in the form of rectangular waveguides for which the long axes x'x are horizontal while the major axis z'z of the elliptical iris 39 is vertical. An elliptical waveguide section 31 whose major axis is inclined at 45° relative to the major axis of the elliptical iris 39 and to the long axis of the waveguides 10 and 12 is disposed in the cavity 30. An elliptical waveguide section 32 having a vertical axis may be disposed between the elliptical waveguide section 31 and the elliptical iris 39.

An elliptical waveguide section 41 is disposed in the cavity 40 and has its major axis parallel to that of the elliptical waveguide section 31. Finally, an elliptical waveguide portion 42 having a vertical axis may be disposed between the elliptical waveguide portion 41 and the elliptical iris 34, 39.

In addition, elliptical waveguide sections 12' and 10' of horizontal major axis x'x are optionally present respectively between the waveguide 10 and the cavity 30, and between the cavity 40 and the waveguide 12.

Each of the cavities 30 and 40 therefore includes two elliptical waveguide portions, namely an elliptical waveguide portion 31 or 41 which serves to couple resonances in degenerate mode, and an elliptical waveguide portion 32 or 42 of inside section smaller than that of the cavities 30 and 40 and which serves for adjustment independent of frequency.

Figure 5C:
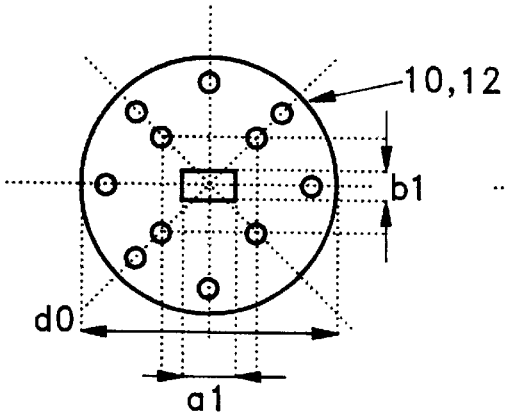
FIGS. 5*c* to 5*h* show various elementary sections of the FIG. 5*b* filter.
Figure 5D:
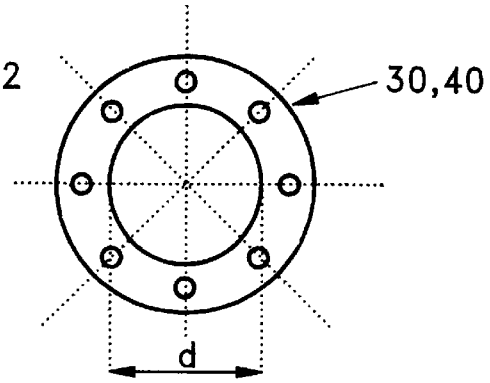
Figure 5E:
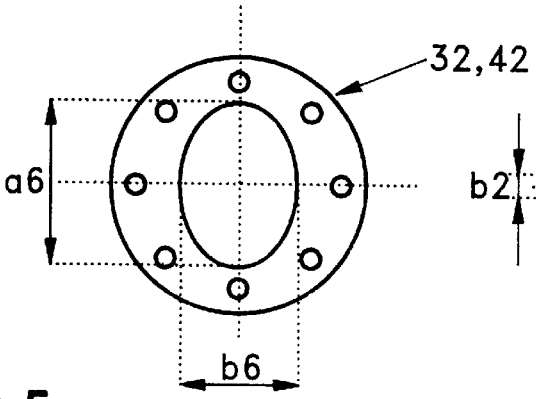
Figure 5F:
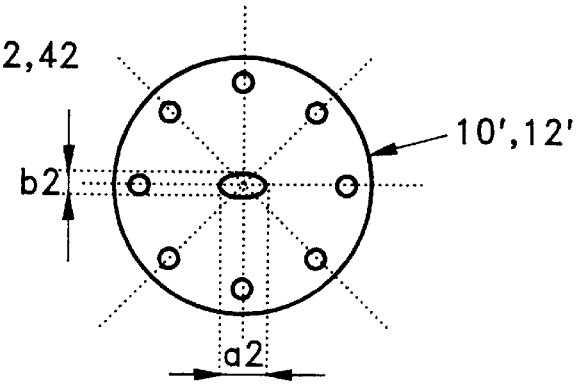
Figure 5G:
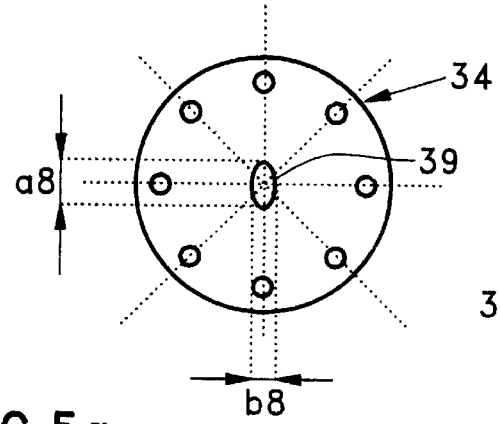
Figure 5H:
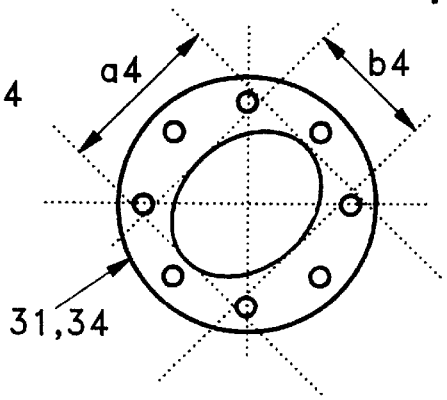

FIGS. 5*c* to 5*h* show the waveguides 10 and 12 (FIG. 5*c*), 30 and 40 (FIG. 5*d*), 32 and 42 (FIG. 5*e*), 10' and 20'(FIG. 5f), 34 (FIG. 5*g*), and finally 31 and 41 (FIG. 5*h*).

| | |
|---|---|
| FIG. 5c | ($a_1$ = 19.05 mm |
| | ($b_1$ = 9.525 mm |
| FIG. 5d | d = 24 mm |
| FIG. 5e | ($a_6$ = 24 mm |
| | ($b_6$ = 20.496 mm |
| FIG. 5f | ($a_2$ = 12.78 mm |
| | ($b_2$ = 4 mm |
| FIG. 5g | ($a_8$ = 8.7 mm |
| | ($b_8$ = 4 mm |
| FIG. 5h | ($a_4$ = 24 mm |
| | ($b_4$ = 21 mm |

with $I_1$=1.7 mm; $I_3$=$I_5$=$I_7$=5.499 mm; $I_4$=0.5 mm $I_6$=0.6 mm; $I_E$=1.39 mm (see FIG. 5*b*).

Figure 6:
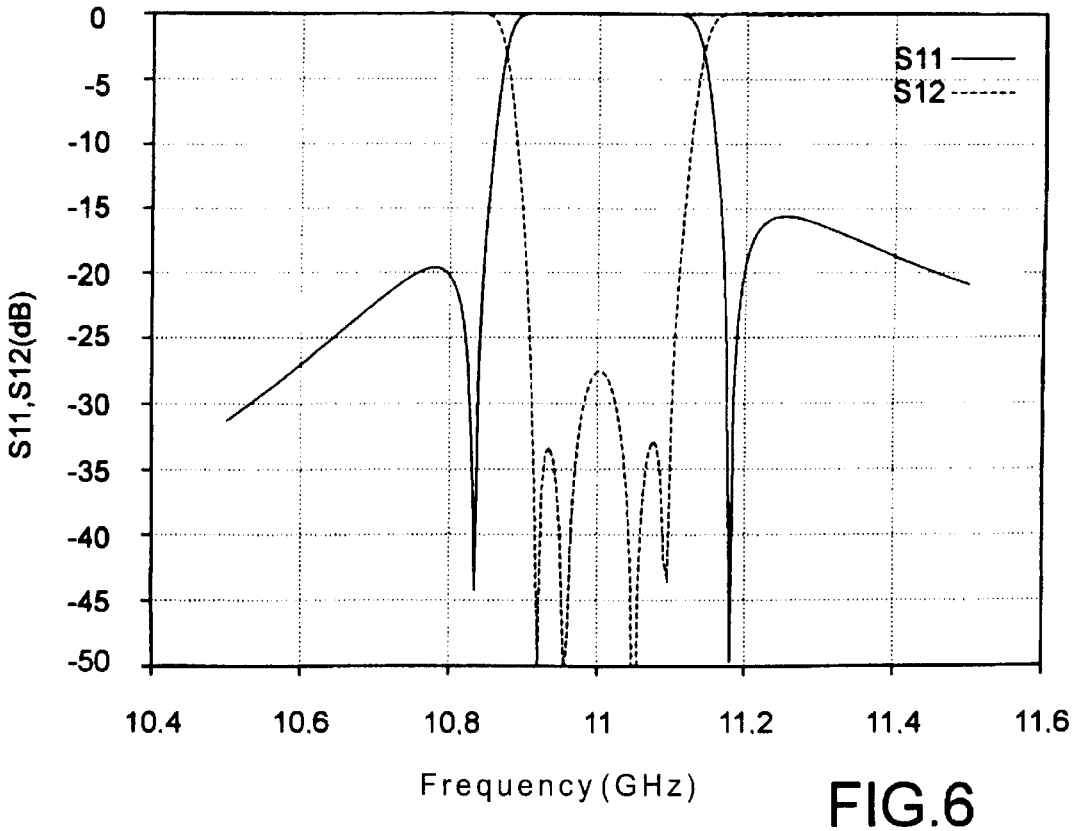

FIG. 6 shows the poles and the zeros which can clearly be identified but which show that the structure can be used effectively for a dual-mode filter.

Naturally, it is also possible to make filters of order higher than 4. This implies a number of cavities greater than 2, with the coupling between pairs of adjacent cavities being provided via respective elliptical irises.

Figure 7A:
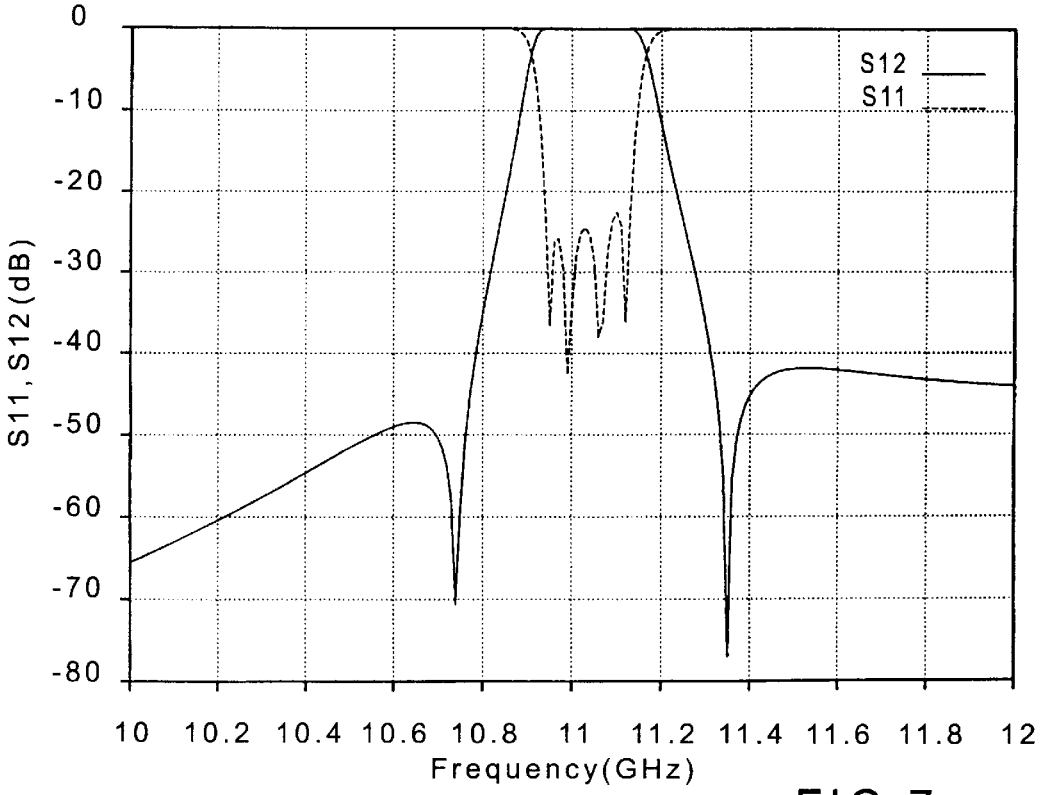
FIGS. 7*a* and 7*b* show examples of response curves for a filter of the invention for the S11 and S12 modes, respectively as obtained by simulation and as obtained by making the filter.
Figure 7B:
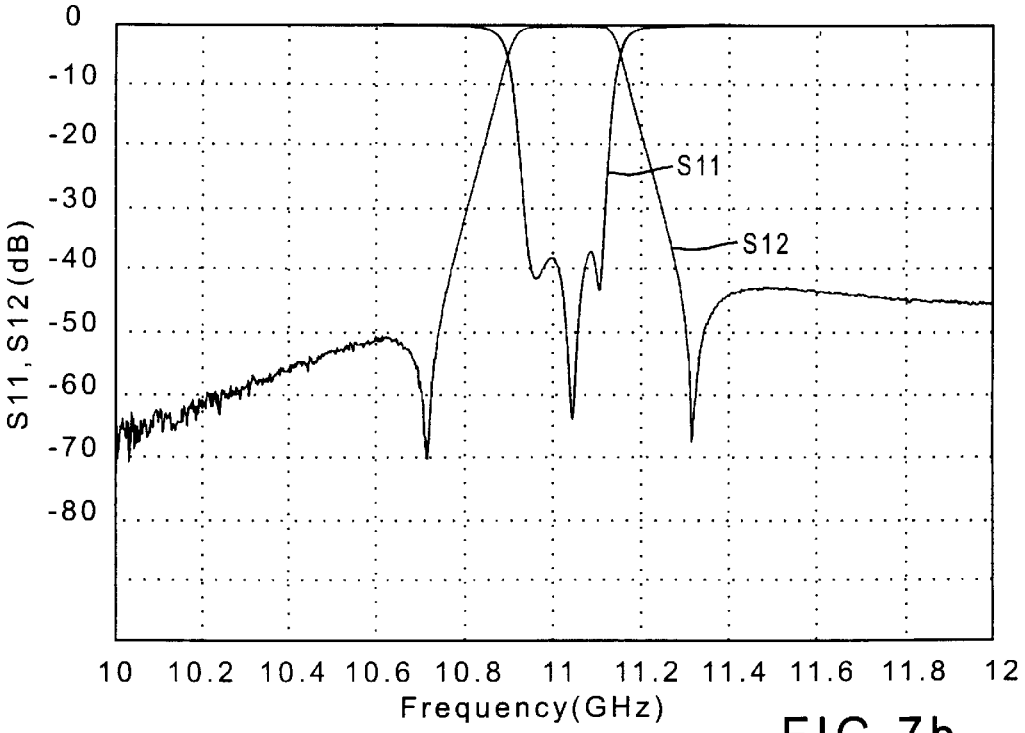

FIGS. 7*a* and 7*b* show the good agreement that exists between the response curve of a simulated filter (FIG. 7*a*) and the response curve of the same filter once made (FIG. 7*b*).

We claim:

1. A circular waveguide dual-mode filter comprising at least one resonant cavity having:

a circular waveguide; and an element to adjust at least one parameter of the resonant without tuning screws, said element being an elliptical waveguide portion for providing cross-coupling between two modes within said resonant cavity, the major and minor axes of said elliptical waveguide portion being disposed perpendicularly to the longitudinal axis of said circular waveguide.

2. A filter according to claim 1, wherein the circular waveguide is coupled to an inlet waveguide having an incident field in first and second mutually perpendicular directions that are perpendicular to the longitudinal axis of the circular waveguide.

3. A filter according to claim 2, wherein the elliptical waveguide portion has an axis in alignment with the first direction.

4. A filter according to claim 2, wherein the elliptical waveguide portion has a major axis at an angle of substantially 45° to the first and second directions.

5. A filter according to claim 2, wherein the circular waveguide includes a cavity coupled to said inlet waveguide and to an outlet waveguide, which inlet and outlet waveguides have long axes that are at an angle to each other of substantially 90°.

6. A filter according to claim 2, wherein the circular waveguide includes at least a first resonant cavity and a second resonant cavity that are coupled together via a coupling iris and each of which includes one of said elliptical waveguide portions.

7. A filter according to claim 6, wherein said coupling iris is an elliptical coupling iris having a major axis perpendicular to said first direction.

8. A filter according to claim 7, wherein the major axes of the elliptical waveguide portions are mutually parallel and form an angle of substantially 45° with said first direction.

9. A filter according to claim 6, wherein each cavity includes an adjustment elliptical waveguide portion interposed between said elliptical waveguide portion and said coupling iris.

10. A filter according to claim 6, wherein the first cavity is coupled to said inlet waveguide and wherein the filter includes an outlet waveguide coupled to the second cavity and wherein the inlet waveguide and the outlet waveguide have long axes that are parallel.

11. A filter according to claim 1, wherein at least one of the inlet waveguide and the outlet waveguide is coupled to said circular waveguide via a coupling iris.

* * * * *

UNITED STATES PATENT AND TRADEMARK OFFICE
CERTIFICATE OF CORRECTION

PATENT NO. : 5,886,594

DATED : March 23, 1999

INVENTOR(S) : Guglielmi et al.

It is certified that error appears in the above-identified patent and that said Letters Patent is hereby corrected as shown below:

In the drawings, Sheet 4 of 6, substitute "Fig. 5a." with the following:

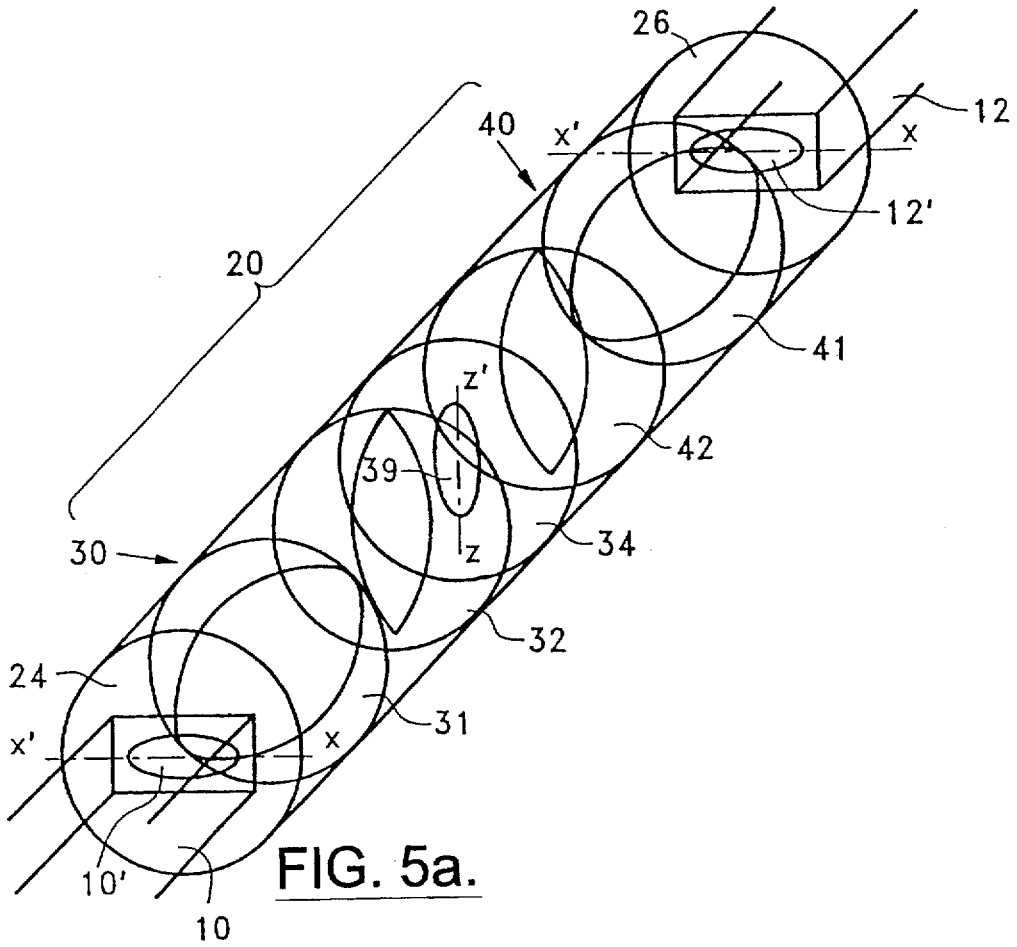

FIG. 5a.

UNITED STATES PATENT AND TRADEMARK OFFICE
CERTIFICATE OF CORRECTION

PATENT NO. : 5,886,594

DATED : March 23, 1999

INVENTOR(S) : Guglielmi et al.

It is certified that error appears in the above-identified patent and that said Letters Patent is hereby corrected as shown below:

Column 6, line 48, after "resonant" insert --cavity--.

Signed and Sealed this

Twentieth Day of July, 1999

*Attest:*

*Attesting Officer*

Q. TODD DICKINSON

*Acting Commissioner of Patents and Trademarks*